US009737999B2

(12) United States Patent
Kommer

(10) Patent No.: US 9,737,999 B2
(45) Date of Patent: Aug. 22, 2017

(54) FOLDING KNIFE WITH TOBACCO CAN OPENER

(71) Applicant: GB II Corporation, Tualatin, OR (US)

(72) Inventor: Russ Kommer, Fargo, ND (US)

(73) Assignee: GB II Corporation, Tualatin, OR (US)

( * ) Notice: Subject to any disclaimer, the term of this patent is extended or adjusted under 35 U.S.C. 154(b) by 661 days.

(21) Appl. No.: 14/108,156

(22) Filed: Dec. 16, 2013

(65) Prior Publication Data

US 2014/0165509 A1 Jun. 19, 2014

Related U.S. Application Data

(60) Provisional application No. 61/737,662, filed on Dec. 14, 2012.

(51) Int. Cl.

| | |
|---|---|
| ***B26B 11/00*** | (2006.01) |
| ***B26B 1/02*** | (2006.01) |
| ***B26B 27/00*** | (2006.01) |
| ***B26B 1/10*** | (2006.01) |

(52) U.S. Cl.

CPC ..... *B26B 11/00* (2013.01); *B26B 1/02* (2013.01); *B26B 1/10* (2013.01); *B26B 27/005* (2013.01)

(58) Field of Classification Search

CPC .... B26B 1/00; B26B 1/02; B26B 1/10; B26B 11/00; B26B 11/001; B26B 11/006; B26B 27/00; B26B 27/002; B26B 27/005

USPC ..... 30/151–162; D8/99; 7/118–120, 7/158–163

See application file for complete search history.

(56) References Cited

U.S. PATENT DOCUMENTS 212,931 A * 3/1879 Heaton ..... A24F 9/02 30/155
234,981 A * 11/1880 Harris et al. ..... D03J 3/00 30/155
438,734 A * 10/1890 Klopp ..... B26B 11/00 30/155
533,504 A * 2/1895 Sonnesen ..... A47G 21/04 7/118
680,586 A * 8/1901 Hawkins ..... B44D 3/162 30/158
1,128,788 A * 2/1915 Joseph ..... B26B 1/02 30/155
1,180,986 A * 4/1916 Divine ..... B67B 7/44 30/152
1,373,993 A * 4/1921 Boe ..... B26B 1/04 30/161
1,381,831 A * 6/1921 Heeren ..... 30/2
1,472,269 A * 10/1923 Grimmer ..... B26B 27/005 30/2

(Continued)

*Primary Examiner* — Jason Daniel Prone
(74) *Attorney, Agent, or Firm* — Klarquist Sparkman, LLP

(57) ABSTRACT

According to one representative embodiment, a knife includes a handle having a forward end portion and a rear end portion, and a blade coupled to the forward end portion of the handle. The handle includes first and second opposing side portions, the first side portion including a cutting member at the rear end portion of the handle and the second side portion including an extension portion at the rear end portion of the handle. The extension portion extends rearwardly past the cutting member in the direction of the length of the handle. The cutting member and the extension portion are spaced apart from each other a distance sufficient to receive the side wall of the lid of a tobacco can.

16 Claims, 2 Drawing Sheets

(56) References Cited

U.S. PATENT DOCUMENTS 1,527,220 A * 2/1925 Pyle ..... B26B 27/005 30/2
1,530,348 A * 3/1925 Blom ..... A24F 9/04 30/155
1,614,578 A * 1/1927 Thom ..... A24F 19/00 30/2
1,705,882 A * 3/1929 Springer ..... B26B 27/005 30/2
1,796,847 A * 3/1931 Leclerc ..... B26B 1/08 30/162
1,796,870 A * 3/1931 Huhn et al. ..... B26B 27/005 30/2
1,821,718 A * 9/1931 Melcher ..... B67B 7/30 30/2
1,908,851 A * 5/1933 Lafever et al. ..... B26B 27/005 30/2
1,941,680 A * 1/1934 Goldstein ..... B26B 27/005 30/2
D98,994 S * 3/1936 Billhimer ..... 30/2
2,067,986 A * 1/1937 Schmidt ..... B26B 27/005 30/2
2,068,020 A * 1/1937 Grounds ..... B26B 27/005 30/2
2,076,007 A * 4/1937 Smith ..... B26B 27/005 30/2
2,095,164 A * 10/1937 Babb ..... B67B 7/30 30/2
2,120,960 A * 6/1938 Arthur ..... B26B 27/005 30/2
2,128,151 A * 8/1938 Lurie ..... B26B 27/005 30/2
2,231,267 A * 2/1941 Giddings ..... B26B 5/00 30/2
2,241,995 A * 5/1941 Holmes ..... B26B 27/005 30/2
2,247,290 A * 6/1941 Disbrow ..... B26B 27/005 30/2
2,271,308 A * 1/1942 Ross ..... B67B 7/30 30/1.5
2,282,697 A * 5/1942 Bates ..... B26B 27/005 30/2
2,441,475 A * 5/1948 Di Veglia ..... F41B 15/00 30/152
2,505,161 A * 4/1950 Van Fleet ..... B26B 27/005 30/2
2,510,530 A * 6/1950 Telschow ..... B65D 5/746 30/2
2,513,905 A * 7/1950 Zurcher ..... B26B 11/001 30/152
2,550,346 A * 4/1951 Gregg ..... B26B 27/005 30/162
2,573,381 A * 10/1951 Arnold ..... B26B 27/005 30/2
2,591,409 A * 4/1952 Dahl ..... B25B 27/00 30/162
2,601,724 A * 7/1952 Jones ..... D04G 3/02 30/294
2,753,105 A * 7/1956 Werner et al. ..... B65D 75/70 30/2
2,797,477 A * 7/1957 Erdman ..... B26B 27/005 30/2
2,896,318 A * 7/1959 Brown ..... B26B 27/005 30/2
2,978,807 A * 4/1961 Lurie ..... B26B 27/005 30/2
3,037,278 A * 6/1962 Genetti, Sr. ..... B26B 5/006 30/151
3,052,977 A * 9/1962 Wise ..... B26B 27/00 30/2
3,057,058 A * 10/1962 Sidney et al. ..... B26B 27/005 30/2
3,178,812 A * 4/1965 Lurie ..... B26B 27/005 30/2
3,184,843 A * 5/1965 Lurie ..... B65B 69/0033 30/2
3,363,315 A * 1/1968 Anderson ..... B26B 11/001 30/152
D218,836 S * 9/1970 Watanabe ..... D8/99
D237,458 S * 11/1975 Laughlin ..... D8/99
D270,655 S * 9/1983 Collins ..... D8/99
4,467,524 A * 8/1984 Ruff ..... B26B 27/005 30/2
4,503,612 A * 3/1985 Davis ..... B26B 27/005 30/2
4,567,655 A * 2/1986 Jacobs ..... B67B 7/34 30/2
4,570,339 A * 2/1986 Taylor ..... A47J 43/28 30/2
4,711,031 A * 12/1987 Annello ..... B26B 27/00 30/2
4,744,146 A * 5/1988 Schmidt ..... B26B 5/001 30/2
4,757,611 A * 7/1988 Tommi ..... G07D 9/006 30/2
5,007,171 A * 4/1991 Horning, Jr. ..... B65B 69/0033 30/2
5,054,198 A * 10/1991 Gmoch ..... B67B 7/30 30/2
5,123,320 A * 6/1992 Hochfeld ..... B26B 27/00 30/2
D328,229 S * 7/1992 Gmoch ..... D8/99
5,220,701 A * 6/1993 Creato ..... B26B 11/001 30/152
D349,444 S * 8/1994 Schmidt ..... D8/99
5,333,381 A * 8/1994 Gelardi ..... B26B 29/06 30/2
D366,407 S * 1/1996 Kendall ..... D8/98
5,529,534 A * 6/1996 Adams ..... A22C 25/006 30/158
5,555,624 A * 9/1996 McCracken ..... B26B 29/06 30/2
5,666,731 A * 9/1997 Rungren ..... B26B 29/06 30/2
5,740,610 A * 4/1998 Ayer ..... B26B 29/02 30/2
6,035,534 A * 3/2000 Abbott ..... B26B 27/002 30/2
6,101,720 A 8/2000 Jones
D435,419 S * 12/2000 Schmidt ..... D8/99
6,314,644 B1 * 11/2001 Raeker ..... B26B 27/005 30/2
D475,910 S * 6/2003 Schmidt ..... D8/99
6,615,495 B1 * 9/2003 Evens ..... B26B 29/06 30/2
D510,693 S * 10/2005 Vaes ..... D8/99
D561,555 S * 2/2008 Fraga ..... D8/99
8,210,075 B2 * 7/2012 Dozier ..... B26B 3/00 30/2
8,572,852 B1 * 11/2013 Jennings ..... B26B 5/001 30/162
D708,499 S * 7/2014 Garavaglia ..... D8/99
D714,124 S * 9/2014 Fujino ..... D8/98
2003/0019337 A1 * 1/2003 Hatanaka ..... B67B 7/44 30/2
2003/0188442 A1 * 10/2003 Imer ..... B67B 7/30 30/1.5
2003/0188443 A1 * 10/2003 Imer ..... B67B 7/30 30/400
2005/0045006 A1 * 3/2005 Addington ..... B26B 27/00 30/2
2007/0234484 A1 * 10/2007 Guffey ..... B26B 11/00 7/158
2008/0086893 A1 * 4/2008 Tsuda ..... B24D 15/084 30/152
2016/0136824 A1 * 5/2016 Glesser ..... B26B 1/048 30/161

* cited by examiner

FOLDING KNIFE WITH TOBACCO CAN OPENER

CROSS REFERENCE TO RELATED APPLICATION

This application claims the benefit of U.S. Provisional Application No. 61/737,662, filed Dec. 14, 2012, which is incorporated herein by reference.

FIELD

The present application concerns embodiments of a folding knife having an integral can opener for opening cans, such as cans containing chewing tobacco.

BACKGROUND

Tobacco cans typically have a paper wrapper that completely covers the junction between the cylindrical side wall of the can and the overlapping side wall of the lid. Thus, before the lid can be removed, the wrapper must be severed along the bottom of the side wall of the lid. Conventional can or bottle openers are not effective for use in opening tobacco cans. It is known to use a sharp tool, such as the blade of a fixed blade knife or folding knife, to sever the paper wrapper and to pry the lid from the can. Unfortunately, some people may find this technique to be awkward or difficult to accomplish.

SUMMARY

According to one representative embodiment, a knife comprises a handle having a forward end portion and a rear end portion, and a blade coupled to the forward end portion of the handle. The handle comprises first and second opposing side portions, the first side portion comprising a cutting member at the rear end portion of the handle and the second side portion comprising an extension portion at the rear end portion of the handle. The extension portion extends rearwardly past the cutting member in the direction of the length of the handle. The cutting member and the extension portion are spaced apart from each other a distance sufficient to receive the side wall of the lid of a tobacco can.

According to another representative embodiment, a knife comprises a handle comprising a forward end portion and a rear end portion, and a blade coupled to the forward end portion of the handle. The rear end portion of the handle comprises means for cutting a paper wrapper on a can of tobacco and removing a lid from the can.

According to another representative embodiment, a method is provided for removing a lid from a can having a paper wrapper covering a cylindrical side wall of the lid and an adjacent cylindrical side wall of the can. The method comprises providing a knife comprising a handle comprising a forward end portion and a rear end portion, the knife further comprising a blade coupled to the forward end portion of the handle, the rear end portion comprising a cutting member and an extension portion spaced from the cutting member. The method further comprises inserting the side wall of the lid between the cutting member and the extension portion, severing the paper wrapper with the cutting member, and removing the lid from the can.

The foregoing and other features and advantages of the invention will become more apparent from the following detailed description, which proceeds with reference to the accompanying figures.

DETAILED DESCRIPTION

For purposes of this description, certain aspects, advantages, and novel features of the embodiments of this disclosure are described herein. The described methods, systems, and apparatus should not be construed as limiting in any way. Instead, the present disclosure is directed toward all novel and nonobvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means physically coupled or linked and does not exclude the presence of intermediate elements between the coupled items absent specific contrary language.

Figure 1:
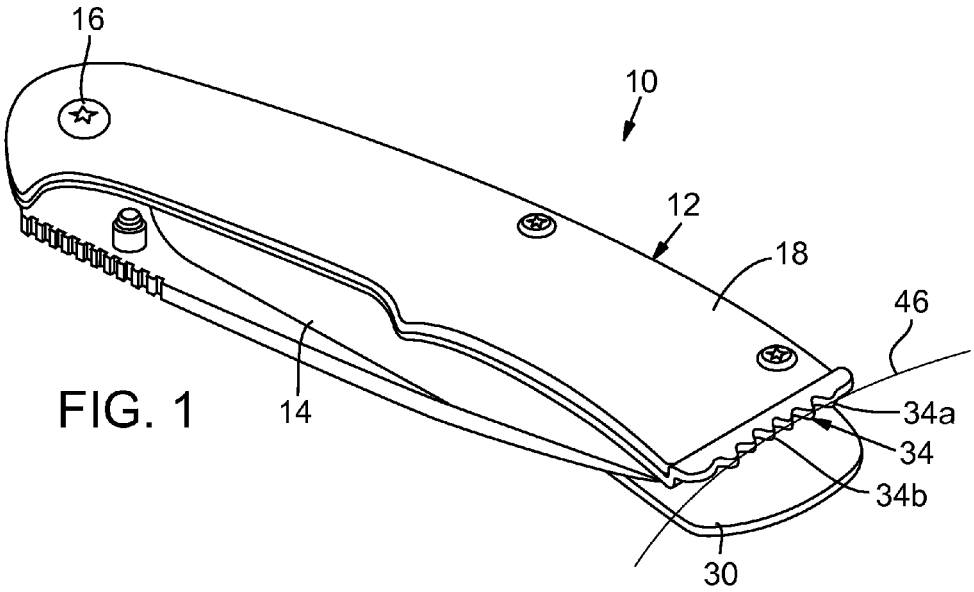
FIG. 1 is a perspective view of a folding knife having an integral can opener, according to one embodiment.
Figure 4:
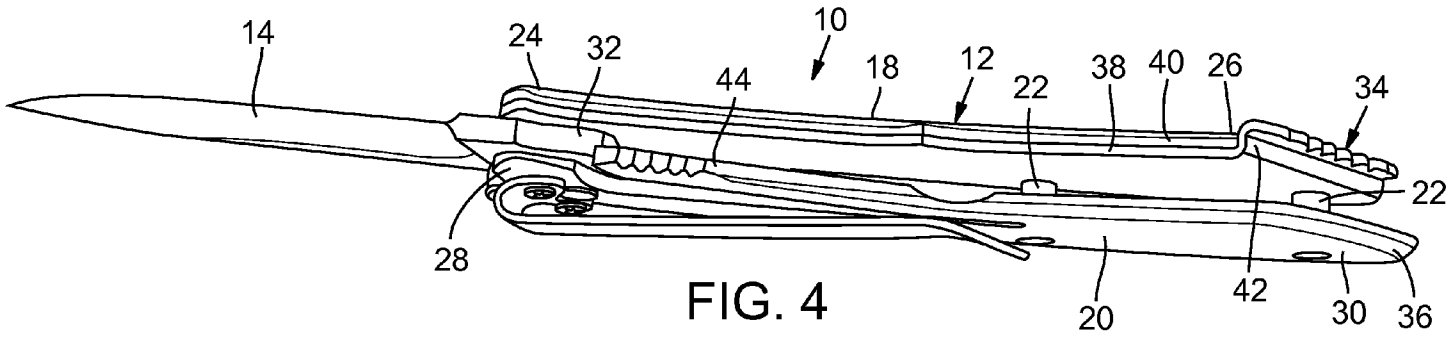
FIG. 4 is a perspective view of the folding knife of FIG. 1, shown with the blade in the open position for use.

Referring to the figures, there is shown a folding knife 10, according to one embodiment. The knife 10 comprises a handle 12 and a blade 14 pivotably connected to the handle 12 by a pivot element 16 (e.g., a screw). The blade 14 is pivotable relative to the handle 12 between a closed position in which the sharpened edge of the blade is inside the handle (FIG. 1) and an open position in which the sharpened edge of the blade is exposed for use (FIG. 4).

The handle 12 in the illustrated embodiment comprises a first side portion 18 and a second, opposing side portion 20 spaced apart from the first side portion so as to define a blade-receiving cavity therebetween. The handle 12 can include one or more spacers 22 extending between and secured to the first and second side portions 18, 20, respectively, as known in the art. As best shown in FIG. 4, the first handle side portion 18 comprises a forward end portion 24 and a rear end portion 26. The second handle side portion 20 comprises a forward end portion 28 and a rear end portion 30. A tang 32 of the blade 14 is supported between the forward end portions 24 and 28. The second side portion 20 can be formed with an integral leaf spring 44 (also referred to as a "liner lock") that can engage a rear surface of the tang 32 to hold the blade 14 in the open position, as known in the art.

Figure 2:
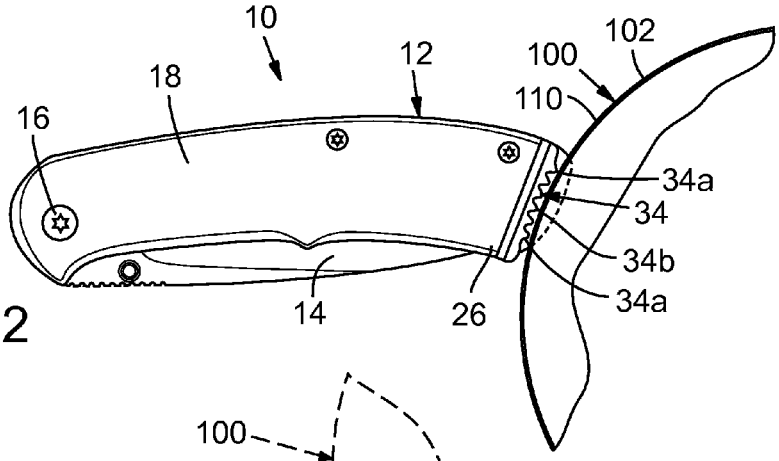
FIG. 2 is a bottom plan view of the folding knife of FIG. 1.
Figure 3:
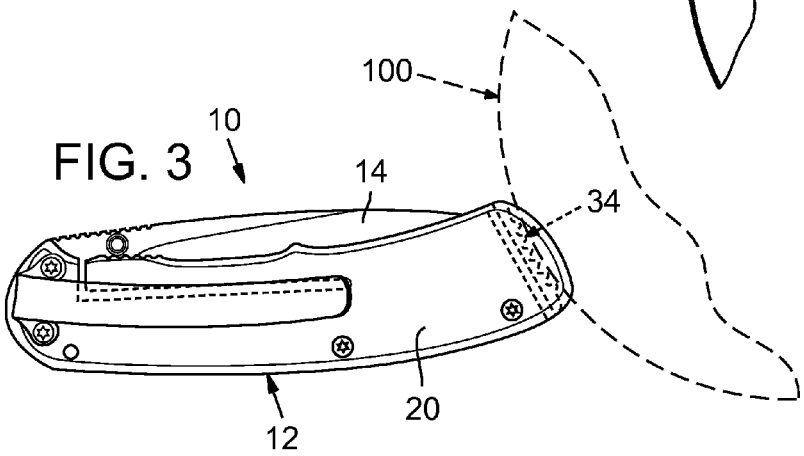
FIG. 3 is a top plan view of the folding knife of FIG. 1.

The rear end portions 26 and 30 together form a can opener that is especially usefully in opening a can of chewing tobacco. The rear end portion 26 of the first side portion 18 comprises a cutting member for cutting or severing the paper wrapper that seals the lid of a can to the adjacent outer surface of the can (e.g., a can of tobacco). The cutting member in the illustrated embodiment comprises a plurality of cutting teeth or serrations 34 that are configured to tear the paper wrapper on a can. As best shown in FIG. 2, the row of teeth 34 can be slightly curved to match the curvature of the side wall of a can 100. Thus, the teeth 34*a* at the ends of the row are shaped to extend slightly beyond the teeth 34*b* between the ends of the row. A curved line 46 (FIG. 1) drawn tangent to the tips of the teeth 34 has a radius of curvature that desirably is the same as the radius of curvature of the can 100.

Figure 5:
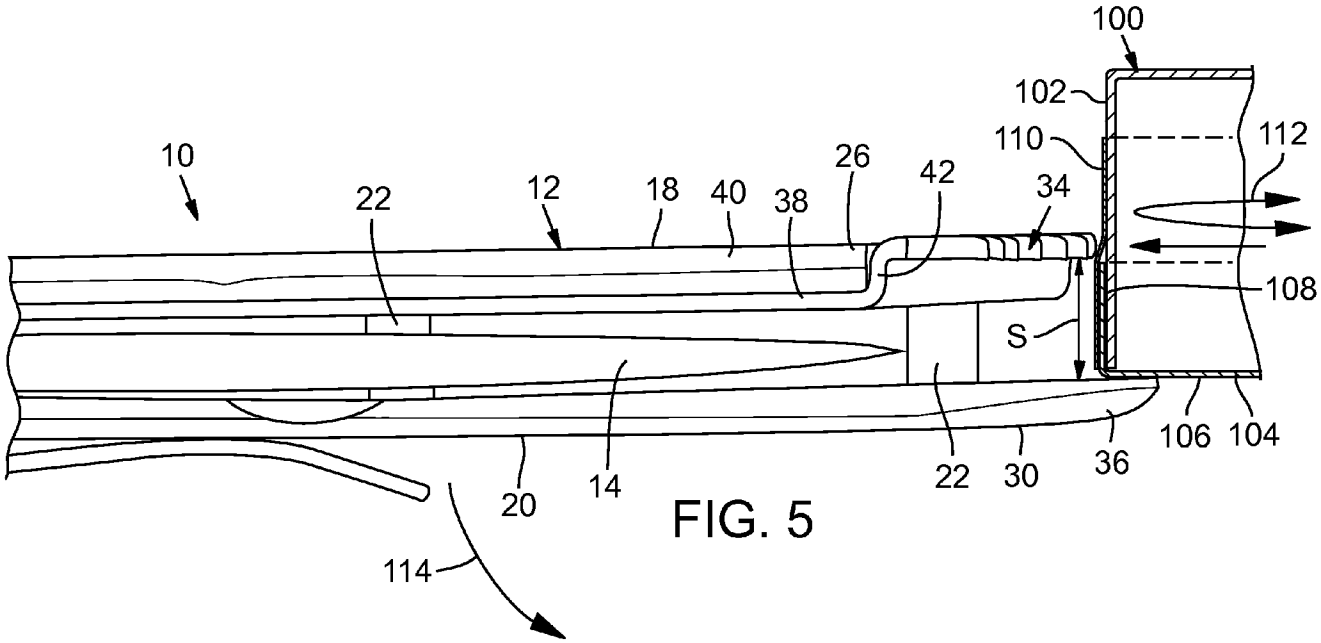
FIG. 5 is an enlarged view of the handle of the knife of FIG. 1, illustrating a method for removing a lid from a can using the integral can opener.

As best shown in FIG. 5, the rear end portion 30 of the second side portion 20 extends rearwardly past the cutting teeth 34 a short distance to define a rear extension 36 that is adapted to engage the upper surface of the lid of a can. The opposing inner surfaces of the rear extension 36 and the cutting teeth 34 define a spacing S that is large enough to receiving the side wall of the lid of a can between the rear extension 36 and the cutting teeth 34, as further discussed below.

In an alternative embodiment, the plurality of cutting teeth 34 can be replaced with a single, continuous (non-serrated) cutting edge or blade formed on the rear end portion 26 of the first side portion 18. The blade can be curved to match the curvature of the can.

The first side portion 18 can be comprised of two plate members: an inner plate member 38 and an outer plate member 40 secured to the outside surface of the inner plate member. As best shown in FIG. 5, the inner plate member 38 can include a generally S-shaped curved portion 42 that extends in a direction laterally away from the blade-receiving cavity and then in a direction parallel to the outer plate member 40. The end of the S-shape curved portion is formed with the cutting teeth 34 in the illustrated embodiment. The cutting teeth 34 desirably are integral to the inner plate member 38, that is, the teeth are machined or otherwise formed on the inner plate member 38. In alternative embodiments, the cutting teeth 34 can be formed on a separate component that is separately formed and subsequently attached to the first side portion 18. Also in alternative embodiments, the first side portion 18 can be comprised of a single plate member having cutting teeth 34 at its rear end.

FIG. 5 shows a portion a can 100, which can be a can of chewing tobacco (the can is shown in an upside-down orientation for purposes of illustration). The can 100 comprises a cylindrical side wall 102 and a lid 104. The lid 104 has an upper wall 106 and a cylindrical side wall 108 that extends downwardly from the outer circumferential edge of the upper wall 106. The side wall 108 overlaps an upper portion of the side wall 102 when the lid is in place on the can. Manufacturers typically include a tearable paper wrapper or seal 110 that extends around the side walls 108, 102 of the lid and the can.

To open the can, the upper wall 106 of the lid is placed on the inside surface of the rear extension 36 and the cutting teeth 34 are placed against the wrapper 110 just below the side wall 108 of the lid. The can 100 is then rotated relative to the knife 10 (as indicated by arrow 112), or vice versa, or the can and the knife are rotated in opposite directions to cause the teeth 34 to create a tear in the wrapper 110 extending around the can. With the teeth 34 positioned against the lower edge of the side wall 108 and while holding the can steady with one hand, the lid 104 can be pried away from the can by moving or the titling handle 18 generally in the direction of arrow 114 using the other hand.

While the illustrated embodiment of the knife 10 is described in connection with opening a can of chewing tobacco, it should be noted that the knife can be used to remove the lid of a can, regardless of the contents of the can. Further, in alternative embodiments, the can opener described above can be incorporated in the handle of a fixed based knife, rather than a folding knife as described above.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A knife comprising:

a handle comprising a forward end and a rear end and a length extending in a direction from the forward end to the rear end; and a blade coupled to the forward end of the handle;

wherein the handle comprises first and second opposing sides, the first side comprising a cutting member, wherein the cutting member comprises a concave cutting edge at the rear end of the handle and the second side comprising an extension portion at the rear end of the handle, the extension portion extending rearwardly past the cutting member in the direction of the length of the handle, the cutting member and the extension portion being spaced apart from each other to define a spacing.

2. The knife of claim 1, wherein the blade is pivotably coupled to the forward end of the handle and configured to move between an open position for use and a closed position at least partially received in a space in between the first and second sides of the handle.

3. The knife of claim 1, wherein the cutting member comprises a plurality of cutting teeth.

4. The knife of claim 3, wherein the plurality of cutting teeth comprises a row of teeth having one or more edge teeth at each of the opposite ends of the row and one or more center teeth located between the one or more edge teeth at one end of the row and the one or more edge teeth at the other end of the row and wherein the one of more edge teeth at each of the ends of the row extend inwardly beyond the one or more center teeth such that an imaginary line drawn tangent to tips of the teeth is a curved line.

5. The knife of claim 4, wherein the curved line has a radius of curvature.

6. The knife of claim 1, wherein the cutting member comprises a curved, non-serrated cutting edge.

7. The knife of claim 1, wherein the first side comprises an S-shaped portion that includes a first section and a second section, the first section extending in a direction laterally away from a blade-receiving cavity formed between the first and the second sides of the handle and the second section extending in a direction parallel to the rear extension portion, and wherein the second section of the S-shaped portion comprises the cutting member.

8. The knife of claim 7, wherein the second section of the S-shaped portion and the extension portion define the spacing therebetween for receiving the side of a tobacco can.

9. A knife comprising: a handle comprising first and second sides each having a forward end and a rear end; a blade coupled to the forward ends of the sides; wherein the rear end of one of the first and second sides comprises a means for cutting a paper wrapper on a can of tobacco and removing a lid from the can, the means for cutting a wrapper comprises a concave cutting edge; wherein the rear end of the other one of the first and second sides comprises an extension portion opposite the cutting edge; and wherein the cutting edge and the rear extension define a spacing therebetween for receiving a sidewall of the lid of the can.

10. The knife of claim 9, wherein the cutting edge comprises a plurality of teeth.

11. The knife of claim 9, wherein the cutting edge has a radius of curvature.

12. The knife of claim 9, wherein the extension portion is adapted to engage an upper surface of the lid of the can.

13. The knife of claim 9, wherein the cutting means comprises an S-shaped portion, wherein the S-shaped portion includes a first section and a second section, the first section extending in a direction laterally away from a blade receiving cavity defined between the first and second sides and the second section extending in a direction parallel to the extension portion, and wherein the second section comprises the concave cutting edge.

14. A method of removing a lid from a can having a paper wrapper covering a cylindrical side wall of the lid and an adjacent cylindrical side wall of the can, the method comprising:

providing a knife as claimed in claim 1; and inserting the side wall of the lid of a tobacco can between the cutting member and the extension portion;

severing the paper wrapper with the cutting member; and removing the lid from the can.

15. The method of claim 14, wherein the act of removing the lid from the can comprises prying the lid away from the can with the cutting member and the extension portion.

16. The method of claim 15, wherein the act of prying the lid away from the can with the cutting member and the extension portion comprises fitting the side wall of the lid into the space between the cutting member and the extension portion such that the cutting member rests beneath a bottom edge of the side wall of the lid.

* * * * *